US006293208B1

(12) United States Patent
Guiot et al.

(10) Patent No.: US 6,293,208 B1
(45) Date of Patent: Sep. 25, 2001

(54) METHOD OF INSTALLATION OF SUPPLY OF AIR OF SOLID AND PULVERIZED FUEL BURNER

(75) Inventors: Roland Guiot; Luigi Russo; Jean-Claude Gauthier; Jean-Claude Pillard, all of Marseilles (FR)

(73) Assignee: Entreprise Generale de Chauffage Industriel Pillard (FR)

( * ) Notice: Subject to any disclaimer, the term of this patent is extended or adjusted under 35 U.S.C. 154(b) by 0 days.

(21) Appl. No.: 09/488,315

(22) Filed: Jan. 20, 2000

(30) Foreign Application Priority Data

Dec. 28, 1999 (FR) ..... 99 16603

(51) Int. Cl.[7] ..... F23B 7/00; F23D 1/00; F23K 3/00

(52) U.S. Cl. ..... 110/233; 110/265; 110/261; 110/266; 110/104.1 R; 110/293; 110/304; 110/342; 110/347; 110/226

(58) Field of Search ..... 110/260, 261, 110/265, 266, 263, 104 R, 202, 293, 301, 302, 304, 342, 347, 106, 226, 232, 233

(56) References Cited

U.S. PATENT DOCUMENTS

| | | | | |
|---|---|---|---|---|
| 3,033,134 | * | 5/1962 | Hennecke | 110/104 |
| 3,393,650 | * | 7/1968 | Daman et al. | 110/7 |
| 3,822,654 | * | 7/1974 | Ghelfi | 110/7 |
| 3,896,746 | * | 7/1975 | Pirsh | 110/104 R |
| 4,186,669 | * | 2/1980 | Cowan et al. | 110/347 |
| 4,236,886 | * | 12/1980 | Ansen et al. | 432/14 |
| 4,310,299 | * | 1/1982 | Binasik et al. | 432/14 |
| 4,428,727 | * | 1/1984 | Deussner et al. | 431/182 |
| 4,474,120 | * | 10/1984 | Adrian et al. | 110/261 |
| 4,492,171 | * | 1/1985 | Brashears et al. | 110/261 |
| 4,532,873 | * | 8/1985 | Rivers et al. . | |
| 4,621,582 | * | 11/1986 | Cooper | 110/264 |
| 4,638,747 | * | 1/1987 | Brock et al. | 110/264 |
| 5,090,339 | * | 2/1992 | Okiura et al. | 110/263 |
| 5,140,916 | * | 8/1992 | Williams | 110/347 |

FOREIGN PATENT DOCUMENTS

| | | | |
|---|---|---|---|
| 1004328 | * | 3/1957 | (DE) . |
| 19742857 | * | 12/1998 | (DE) . |
| 60-207823 | * | 10/1985 | (JP) . |
| 60-223913 | * | 11/1985 | (JP) . |

* cited by examiner

*Primary Examiner*—Henry Bennett
*Assistant Examiner*—Kenneth B. Rinehart
(74) *Attorney, Agent, or Firm*—Bachman & LaPointe, P.C.

(57) ABSTRACT

In a method of supplying air to a pulverized solid fuel burner passing through the burner cowl of a furnace, the fuel is dried and then conveyed by means of a given large quantity of hot air, which may or may not be depleted in oxygen in a separator in which the fuel is extracted from it. The fuel is then conveyed to the burner by means of a first portion only of the air from which the fuel has been removed. This conveyor air portion is used as primary combustion-supporting air for burning the fuel in the burner, into which the first portion of air, mixed with the fuel it conveys, is fed via an annular duct. The other portion of the hot air purified in the separator is used at least as additional primary combustion-supporting and flame adjustment air and is fed into the burner peripherally and centrally relative to the first portion of air charged with fuel.

11 Claims, 2 Drawing Sheets

METHOD OF INSTALLATION OF SUPPLY OF AIR OF SOLID AND PULVERIZED FUEL BURNER

BACKGROUND OF THE INVENTION

1. Field of the Invention

The present invention relates to a method of and an installation for supplying air to a pulverized solid fuel burner.

The technical field of the invention is the manufacture of an industrial burner.

The main application of the invention is to the manufacture of burners for rotary furnaces supplied with fuel directly from the grinder producing the pulverized solid fuel by means of a pneumatic conveyor and without intermediate storage between said grinder and the burner.

2. Description of the Prior Art

Installations of the above kind in which all of the air passing through the grinder is used as conveyor air are well known in the art. The metering of the pulverized solid fuel is performed by weighing the unprocessed solid fuel which is then fed into the grinder. The grinder can also serve as a drier using hot air and/or smoke, whose maximum temperature can be as high as 400° C. The combination of the hot drying air and the steam produced in this way then serves as a gas for conveying the pulverized solid fuel to the burner. The concentration of pulverized solid fuel relative to the conveyor air is relatively low, in the order of 0.3 kg to 0.6 kg per $Nm^3$ of air under nominal conditions. This value varies as a function of the burner load, because the pulverized solid fuel is metered with a constant gas flowrate. For a variation of 1 to 3 the minimum concentration is therefore divided by 3. This high proportion of transport air, which is then wet and cold, at a temperature from 60° C. to 90° C., and which constitutes a major part of the primary air supporting combustion of the fuel in the burner, limits the efficiency of the rotary furnace and rules out adjustment of the shape of the flame.

A variant of what might be called direct combustion as described above has therefore been developed and is based on the same general principle, i.e. the fuel, such as coal, is metered before it is ground, and there is no intermediate storage of the fuel between the grinder and the burner; however, to enable the flowrate of air injected into the furnace to be reduced, an air/coal cyclone separator is installed on the conveyor line after the grinder and all of the air charged with fuel from the grinder is injected into this separator: this variant is referred to as semi-direct combustion. At the exit from the cyclone the pulverized solid fuel, referred to as PSF in the remainder of the description, is taken up by a pneumatic conveyor using purified air recovered from the outlet of the separator. The flowrate of air injected into the furnace in this way, transporting the PSF and forming primary combustion-supporting air, is lower than in the case of the direct combustion previously mentioned, because a portion of the drying gases is recycled after purification: this portion, corresponding to the portion of the purified air that is not used as the conveyor gas, is re-injected into the air supply circuit of the dryer-grinder. However, the quantity of primary air injected into the furnace remains high and the PSF concentration, which is undoubtedly higher than that obtained with direct combustion, remains limited to 0.6 $kg/Nm^3$ to 1 $kg/Nm^3$.

Accordingly, these old direct and semi-direct combustion technologies do not allow the use of modern burners like that described in European patent No. 0 421 903 filed Apr. 10, 1991 and used in ROTAFLAM type burners: in these burners the shape of the flame is adjusted using pulses generated at a high rate from two primary air circuits additional to that conveying the gas fuel, the total primary air used representing only a small percentage, around 6%, of the total combustion-supporting air. To minimize the effect of the conveyor air it is necessary to use a conveyor circuit with a high concentration, in the order of 3 $kg/Nm^3$ to 6 $kg/Nm^3$, i.e. around ten times greater than with direct combustion.

To this end, installations which might be referred to as indirect combustion installations have been constructed in which the PSF is stored between the grinder and the burner, which has the advantage of making the operation of the installation independent of the grinder. The PSF is metered at the exit from the storage silo by a continuous weighing system. The PSF is then conveyed by means of ambient air whose pressure can be increased at will and the minimized flowrate allows a relatively high PSF concentration of from 4 kg to 8 kg per $Nm^3$, which represents an increase in the efficiency of the furnace. It is then possible to use multicircuit burners like those described in the aforementioned patent application with a low primary air rate which allows adjustment of the shape of the flame, improving heating and reducing the emission of pollutants such as nitrogen and carbon oxides. The major drawback of these indirect combustion schemes is their high cost, however; additional to this is the necessity to use a sleeve filter on the dust extraction circuit for the drying air because this air is discharged to atmosphere and can represent an explosion hazard for fuels with a high concentration of volatile materials.

The problem addressed is therefore that of providing installations for feeding air to a pulverized solid fuel burner enabling adjustment of the shape of the flame, for improved efficiency, and reduced formation of nitrogen oxides, in conformance with recent regulations, as in the case of the burners described in the previously mentioned patent EP 0 421 903, in particular by increasing the concentration of pulverized solid fuel relative to conveyor air to at least 2 kg per/$Nm^3$ before it is injected into the burner. Such air and fuel supply installations must also not reject conveyor air that has also been used for drying, even after purifying it, because it still contains polluting and inflammable solid materials in suspension. Such installations must also be suitable for retrofitting to existing installations without major investment, such as adding heavy plant, as in indirect combustion installations.

SUMMARY OF THE INVENTION

One solution to the problem addressed is a method of supplying air to a pulverized solid fuel burner passing through the burner cowl of a furnace, in which method the fuel is dried and then conveyed by means of a given large quantity of hot air, which may or may not be depleted in oxygen in a separator in which the fuel is extracted from it, which fuel is then conveyed to the burner by means of a first portion only of the air from which the fuel has been removed, and this conveyor air portion is used as primary combustion-supporting air for burning the fuel in the burner, into which the first portion of air, mixed with the fuel it conveys, is fed via an annular duct; according to the invention:

and the other portion of the hot air purified in the separator is used at least as additional primary combustion-supporting and flame adjustment air and is fed into the burner peripherally and centrally relative to the first portion of air charged with fuel; and a portion of the other portion of purified air is used as additional combustion-supporting secondary air and is fed into the furnace via the burner cowl on the upstream side of and laterally relative to the end of the head of the burner.

In a preferred embodiment of the invention specifically suited to burners such as three-circuit burners and burners corresponding to patent application EP 0 421 903:

additional combustion-supporting primary air is fed into the burner, consisting of the other portion of the purified air, via at least two annular ducts, one discharging axially and the other following rotation of the end of the head of the burner; and the flow of air between the various supply circuits of the burner is adjusted by means of the other portion of the purified air by moving the corresponding annular ducts axially relative to each other.

Regardless of the burner employed, all of the hot air charged with pulverized solid fuel which has been dried is introduced into the separator and all of the purified hot air from the outlet of the separator is re-used as combustion-supporting air.

Another solution to the problem addressed is an installation for supplying air to a pulverized fuel burner enabling implementation of the air supply method in accordance with the invention as defined hereinabove and described in more detail hereinafter.

The result is new methods of and installations for feeding air to a pulverized solid fuel burner which address the stated problem without having the drawbacks of direct, semi-direct and indirect installations currently in use: in fact, the present invention may be considered as an improvement to semi-direct installations in which all of the hot air charged with PSF at the outlet from the grinder is fed into the separator to be totally purified therein.

According to the invention, reducing the primary air injected into the burner in this way improves the efficiency of the furnace and reduces the emissions of nitrogen oxide, which are highly sensitive to the quantity of oxygen fed into the burner; the surplus air recovered at the outlet from the separator is evacuated into the furnace at the level of the burner cowl and has no influence on combustion because it mixes with the secondary air several meters upstream of the start of the flame; moreover, because the conveyor air can be minimized, its momentum is low compared to the other peripheral feeds of primary air and it is therefore possible to adjust the shape of the flame and therefore to optimize the heating of the product to be treated, such as raw materials from quarries to form clinker used in cement, which must be heated to a temperature of approximately 1400° C.

Other advantages of the present invention could be cited, but those cited hereinabove are sufficient to show the novelty and the benefit of the invention.

The description and the accompanying drawings explain one embodiment of the invention but are not limiting on the invention: other embodiments are possible within the scope of the invention.

DETAILED DESCRIPTION OF THE PREFERRED EMBODIMENTS

Figure 1:
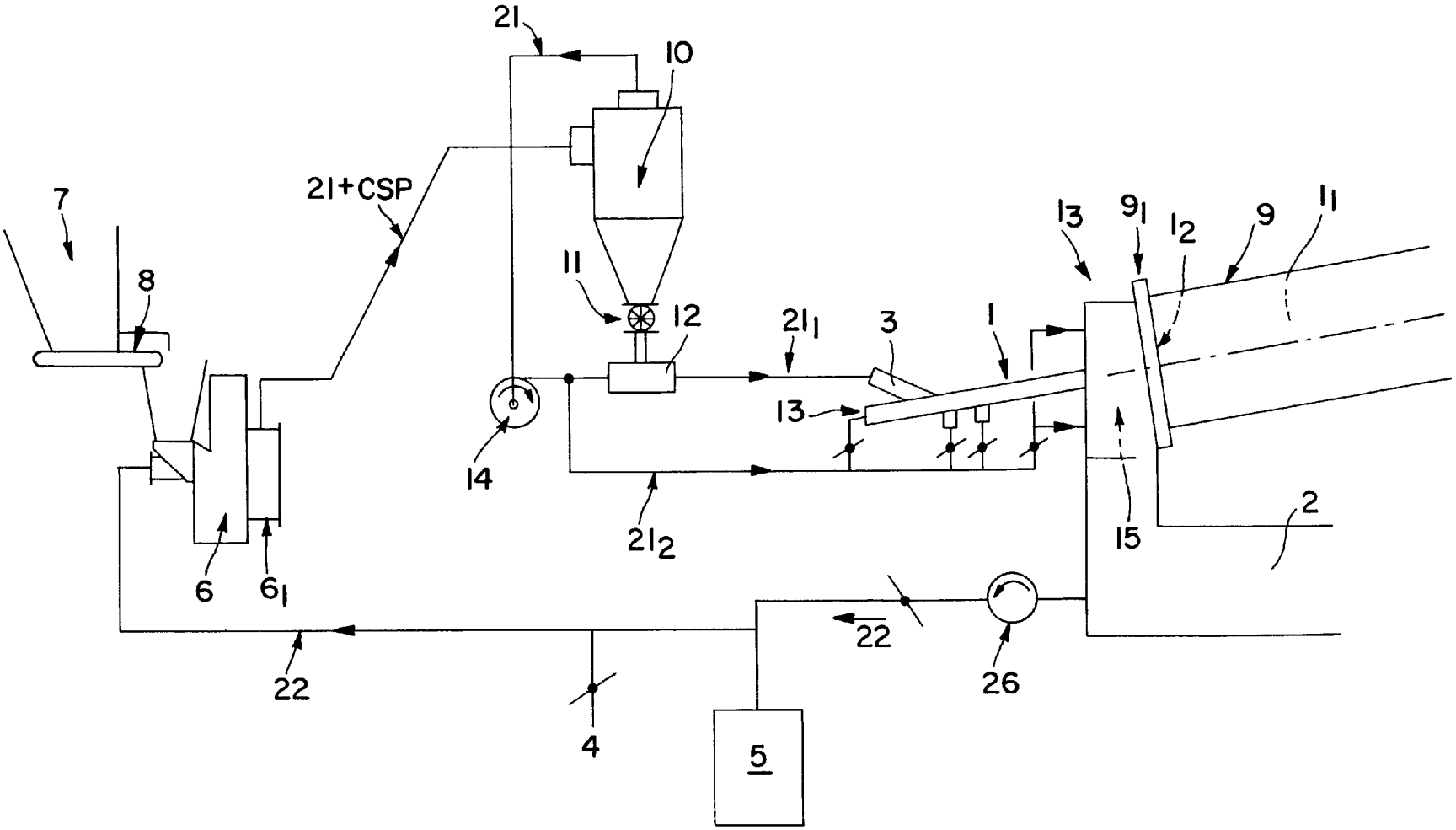
FIG. 1 is a general block schematic of an installation in accordance with the invention for supplying air and a pulverized solid fuel such as coal to a rotary furnace.

The installation for feeding air to the pulverized solid fuel (PSF) burner 1 passes through the burner cowl 19 and includes at least one separator 10 in which the fuel is extracted from the hot air 21 used to dry it and to convey it to this point and at least one primary air supply circuit $\mathbf{21}_1$ in which the pulverized solid fuel is conveyed from the separator 10 by a first portion of the air purified in the separator 10; this supply circuit discharges into the burner 1 through an annular axial duct 23.

Figure 2:
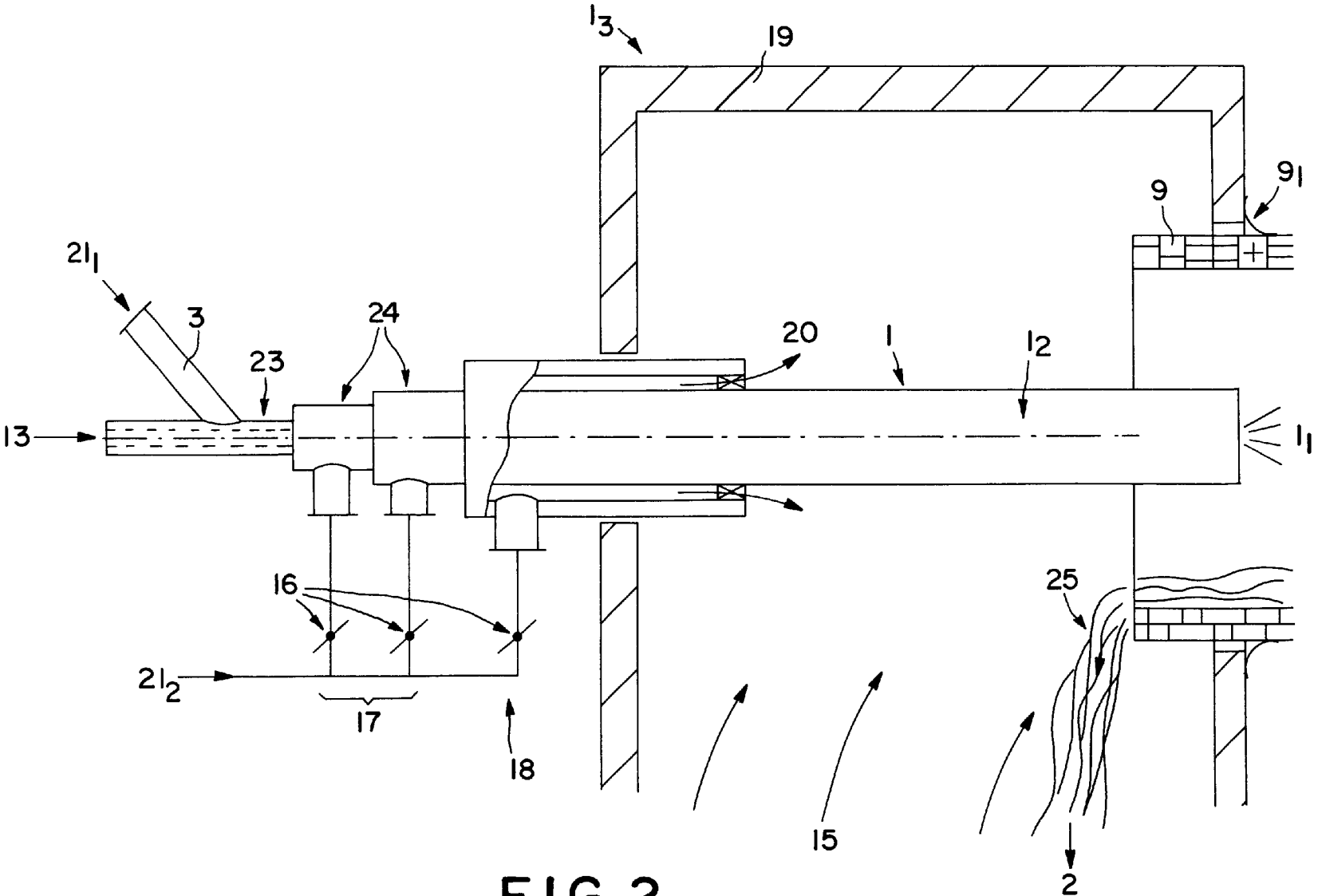
FIG. 2 is a simplified view in axial section of a ROTAFLAM pulverized solid fuel burner which is the subject matter of the patent referred to in the preamble and which is fed with combustion-supporting air by the method of the invention.

The furnace $\mathbf{1}_3$ shown in the accompanying FIGS. 1 and 2 includes an inclined rotating tube 9 whose interior volume constitutes the combustion chamber $\mathbf{1}_1$ into which flows a material 25 which is melted therein and then directed to a cooler 2. The rotating tube 9, referred to as a rotating furnace $\mathbf{1}_3$, therefore rotates around the burner head $\mathbf{1}_2$ and discharges into the burner cowl 19 via a seal $\mathbf{9}_1$.

The separator 10, which can be a cyclone, is fed with all of the hot air 21 charged with PSF from a grinder 6; the grinder can incorporate a fan 6, which dries the PSF with the hot air 21 and conveys it to the separator 10. The unprocessed coal fuel is fed into the grinder 6 from a hopper 7 and a weighing belt charger 8 which controls the quantity of coal introduced into the supply circuit 21.

The grinder 6 supplies the conveyor and hot air supply circuit 21 with hot air 22 from the cooler 2, whence it is extracted by a fan 26 and wherein heat is recovered from the material 25 which is heated in the combustion chamber $\mathbf{1}_1$ of the furnace $\mathbf{1}_3$ and leaves it at a temperature from 800° C. to 1000° C.: if the air 22 is not hot enough to dry the coal, i.e. at a temperature at least in the order of 250° C. to 400° C., especially when starting up the furnace, it is heated by means of a hot gas generator 5 of any kind; if it is too cold, it is cooled by injecting cool air 4. The additional hot gas generator 5 can itself be a burner, which therefore introduces combustion products into the air circuit 22, which is therefore depleted in oxygen.

The installation in accordance with the invention includes at least one fan 14 in the outlet circuit of purified air from the separator 10 and adapted to convey at least the pulverized solid fuel and a first portion $\mathbf{21}_1$ of the purified air to the furnace $\mathbf{1}_1$ into which it is fed at 3 via the burner 1. The fan 14 can feed all of the purified air supply circuits from the outlet of the separator 10 to the burner 1 on its own and at any required pressure, using any adjustment system known in the art for this purpose.

The first portion $\mathbf{21}_1$ of the purified air, used as conveyor air to feed the burner 1, is fed to the base of the separator 10 via an injector 12 which entrains PSF which drops into it via a rotary valve 11 for separating the interior volume of the separator cyclone 10 and the conveyor circuit, which are at different pressures: in accordance with the invention, the pulverized solid fuel is then conveyed to the burner 1 by means of this first portion $\mathbf{21}_1$ of the purified air, with which it is mixed in proportions from at least 2 kg per $Nm^3$ to as much as 4 kg pert$Nm^3$.

At least some of the other portion $\mathbf{21}_2$ of the purified air which feeds a second additional primary air circuit is fed into the burner 1 via at least two ducts which are disposed peripherally (duct 24) and centrally (duct 13) relative to the annular duct 23 feeding the pulverized solid fuel.

Moreover, a portion 18 of this other portion 212 of the purified air is used as additional secondary combustion-supporting air and is fed into the furnace $\mathbf{1}_3$ via the burner cowl 19, upstream and to the side relative to the end of the burner head $\mathbf{1}_2$.

This additional secondary air 18 is preferably injected into an annular duct 20 around the burner 1, which avoids having to modify the burner cowl 19, in which case the annular duct 20 is integrated into the burner; however, in a different embodiment of the invention, the additional secondary air 18 can be injected via nozzles passing through the burner cowl 19: there it mixes with the main secondary air 15 from the cooler 2 and is heated like the drying hot air 22 which is extracted from it: the secondary air 15 is at a temperature from 800° C. to 1200° C., depending on the furnace, and dust which is not separated out by the separator cyclone 10 and is therefore present in the air 18 injected into the burner cowl 19 therefore ignites immediately. The outlet cross sections of the nozzles or of the annular space 20 are designed to prevent any blowback caused by an exit speed much greater than the flame propagation speed.

The installation in accordance with the invention can include valves 16 for dividing the flow between the various circuits supplying the burner 1 with the other portion $\mathbf{21}_2$ of the purified air.

The rule must be to maintain the axial momentum at the outlet from the tip or head $\mathbf{1}_2$ of the burner (the momentum being the product of the speed by the mass): the increase in pressure due to the fan 14 increases the speed at the outlet from the tip of the burner to approximately 130 meters per second, rather than the 70 to 90 meters per second obtained with direct combustion: it is then possible to halve the quantity of primary air for the same momentum, provided that the initial quantity available is of course sufficient, a minimum quantity (namely 6% to 8% of the theoretical combustion-supporting air) being required for correct operation of the burner, given that in accordance with the invention a maximum of 5% of the total combustion-supporting air introduced into the burner is preferably used in accordance with the invention as the primary combustion-supporting air $\mathbf{21}_1$ and for conveying the fuel to the burner 1.

One example of the distribution of the flow of air by the method of the invention is as follows:

- the quantity of hot air 22 then 21 used in the air supply circuits in accordance with the invention can be 30% of the total combustion-supporting air required and the PSF concentration between the grinder 6 and the separator cyclone 10 can be 0.33 kg per $Nm^3$;
- at the outlet from the cyclone separator 10 the purified air 21 always represents 30% of the total combustion-supporting air, contains virtually no PSF and is separated into two portions $\mathbf{21}_1$ and $\mathbf{21}_2$;
- the first portion $\mathbf{21}_i$ can be 2.25% of the total combustion-supporting air and conveys the PSF from the outlet of the separator 10 to the furnace $\mathbf{1}_3$ at a concentration of 4 kg per $Nm^3$;
- the other portion $\mathbf{21}_2$ of the purified air then represents 27.75% of the total combustion-supporting air and is divided into peripheral 17 and central 13 additional primary air portions representing 15% of the total combustion-supporting air, and the remainder, i.e. 12.75% of the total combustion-supporting air, is used as additional secondary air 18.

In this case, the total quantity of primary air introduced into the burner 1 is therefore 17.25% of the total combustion-supporting air, representing a reduction of about 40% compared to the prior art direct combustion process in which all of the conveyor air 21 is injected as primary air into the burner. As a result, the present invention significantly reduces the quantity of nitrogen oxides.

Moreover, the conveyor air $\mathbf{21}_1$ represents no more than 2.25% of the combustion-supporting air, rather than 30% as in existing direct combustion schemes.

What is claimed is:

1. A method of supplying air to a pulverized solid fuel burner passing through a burner cowl of a furnace, in which method pulverized solid fuel is dried and then conveyed by means of a given large quantity of hot air in a separator in which said fuel is extracted from said hot air, which fuel is then conveyed to said burner by means of a first portion of the air from which the fuel has been removed, said first air portion being used as primary combustion-supporting air for burning said fuel in said burner, into which said first portion of air mixed with said fuel is fed via a first annular duct, a second portion of said hot air purified in said separator being used at least as additional primary combustion-supporting and flame adjustment air and being fed into said burner peripherally and centrally relative to the first portion of air charged with fuel.

2. The method claimed in claim 1 wherein a portion of said second portion of purified air is used as additional combustion-supporting secondary air and is fed into said furnace via said burner cowl on an upstream side of and laterally relative to an end of a head of said burner.

3. The method claimed in claim 2 wherein said additional secondary air is injected into a second annular duct around said burner.

4. The method claimed in claim 1 wherein additional combustion-supporting primary air is fed into said burner, consisting of said second portion of said purified air, via at least two annular ducts disposed peripherally and centrally relative to said first annular duct.

5. The method claimed in claim 1 wherein all of said hot air charged with said pulverized solid fuel which has been dried is introduced into said separator and all of said purified hot air from an outlet of said separator is re-used as combustion-supporting air.

6. The method claimed in claim 1 wherein at most 5% of the total combustion-supporting air introduced into said burner is used as primary combustion-supporting air and to convey fuel into said burner.

7. The method claimed in claim 1 wherein said pulverized solid fuel is conveyed to said burner by means of said first portion of said purified air, with which said pulverized solid fuel is mixed to a concentration of at least 2 kg per $m^3$.

8. The method claimed in claim 1 wherein said hot air is depleted of oxygen.

9. An installation for supplying air to a pulverized solid fuel burner passing through a burner cowl of a furnace, said installation including at least one separator in which pulverized solid fuel is extracted from hot air that has been used to dry and to convey said fuel thereto, at least one circuit for supplying primary air in which the pulverized solid fuel is conveyed from said at least one separator and which consists of a first portion of the air purified in said at least one separator, said at least one supply circuit introducing and circulating said primary air in said installation and discharging into said burner via an annular duct, means associated with said at least one supply circuit for creating a flow of said first portion of said primary air and said pulverized solid fuel in said at least one supply circuit, and at least one second circuit for supplying additional primary air to said installation consisting of a second portion of the purified air and fed into said burner via at least two ducts disposed peripherally and centrally relative to said axial annular duct.

10. The installation claimed in claim 9 wherein said flow creating means comprises at least one fan in a purified air outlet circuit from said separator and said at least one fan conveying at least said pulverized solid fuel with said first portion of the purified air to said furnace via said burner.

11. The installation claimed in claim 9 including valves for distributing the flow between the various circuits for supplying said burner with said other portion of said purified air.

* * * * *